United States Patent [19]

Houghteling

[11] Patent Number: 4,976,050

[45] Date of Patent: Dec. 11, 1990

[54] BABY BOOTIE

[76] Inventor: Barbara Houghteling, P.O. Box 658, Tabernash, Colo. 80478

[21] Appl. No.: 244,150

[22] Filed: Sep. 14, 1988

Related U.S. Application Data

[63] Continuation of Ser. No. 34,608, Apr. 6, 1987, abandoned.

[51] Int. Cl.[5] ..... A43B 1/02; A43B 3/16; A43B 3/10

[52] U.S. Cl. ..... 36/9 R; 36/11; 36/7.1 R

[58] Field of Search ..... 36/7.1 R, 9 A, 9 R, 36/112, 11, 11.5

[56] References Cited

U.S. PATENT DOCUMENTS

| | | | |
|---|---|---|---|
| 1,458,717 | 6/1923 | Lochwitzky | 36/9 R |
| 2,210,475 | 8/1940 | Trimble | 36/9 A |
| 2,305,926 | 12/1942 | Kohler | 36/9 R |
| 2,444,822 | 7/1948 | Griffin | 36/11 |
| 2,513,005 | 6/1950 | Crawford | 36/11.5 |
| 2,563,092 | 8/1951 | Zacks | 36/9 R |
| 2,630,636 | 3/1953 | Cockrell | 36/9 R |
| 2,803,894 | 8/1957 | Morgan | 36/9 R |
| 2,973,589 | 3/1961 | Rigsby | 36/11 |
| 3,058,241 | 10/1962 | Rigsby | 36/112 |
| 3,142,911 | 8/1964 | Waters | 36/11 |
| 4,616,428 | 10/1986 | Leger | 36/9 R |

FOREIGN PATENT DOCUMENTS

| | | | |
|---|---|---|---|
| 155747 | 12/1920 | United Kingdom | 36/11 |

*Primary Examiner*—Steven N. Meyers

[57] ABSTRACT

A bootie to be worn on a baby's foot is fashioned from a single piece of material. The body of material includes a substantially oval-shaped upper section, a substantially barrel-shaped center section, a substantially bulbous lower section and a substantially rectangular shaped section disposed between the barrel-shaped section and the oval-shaped section. The rectangular section is wider than the barrel section, thereby forming a pair of ears along its lower surface. A bootie shape may be formed by appropriately folding and sewing the body. An elastic band is sewn in a stretched condition to the portion of the bootie wrapping about the baby's ankle such that the elastic band also extends about the ankle. The male member and the female member of a snap fit fastener are attached respectively to opposite ends of the elastic band so that the bootie can be secured about the baby's ankle.

52 Claims, 1 Drawing Sheet

BABY BOOTIE

This is a continuation of application Ser. No. 034,608, filed Apr. 6, 1987, now abandoned.

FIELD OF THE INVENTION

The present invention relates generally to footwear. More particularly, the present invention relates to a bootie made out of a single piece of fabric that provides a wide opening for insertion of a foot yet maintains a tight fit about the wearer's ankle.

BACKGROUND OF THE INVENTION f

When providing footwear for small children, there are numerous factors that a designer must consider. It is desirable to provide a bootie that is soft, comfortable, easy to put on, yet securely fastenable about the child's ankle. While standard booties may be adequately secured to the child's foot, they have several drawbacks. When attempting to place a standard bootie on a baby, the youngster will often curl its toes or otherwise resist the effort, making it difficult to insert the foot within opening provided. Booties with large openings tightened by a drawstring or laces often suffer the major drawback of not being securely fastenable to the foot because the laces come untied. Thus, as a child crawls, rolls or walks about, the bootie may come off and become accidently lost.

Another major objective of a footwear designer for small children is to produce a shoe or bootie that is relatively inexpensive and simple to manufacture, since cost is often a major factor in the sales of baby footwear. Along these lines it is desirable to design footwear that can be readily produced with good quality control as to the size and appearance of the finished product. Booties fashioned from multiple pieces of material tend to suffer the drawback of inconsistency in size, shape and appearance due to variations in the assembly of the multiple pieces from bootie to bootie. The present invention describes a novel bootie construction fashioned from a single piece of material that seeks to address these and other problems found in conventional baby footwear.

SUMMARY OF THE INVENTION

An object of the present invention is to provide a bootie that may be opened widely to easily receive the insertion of a foot. Another object is to provide a bootie that may be securely fastened about the ankle so that the bootie is not easily lost.

A further object of the present invention is to provide a bootie that may be fashioned from a single piece of material. Yet another object is to provide a bootie that is soft and comfortable for the wearer.

Additional objects and advantages of the invention will be set forth in part in the description which follows, and in part will be obvious from description, or may be learned by practice of the invention.

To achieve these and other objects, the present invention provides a bootie including a fabric body fashioned from a single piece of material having a substantially oval-shaped upper section, a substantially barrel-shaped center section, a substantially bulbous lower section, and a substantially rectangular-shaped section disposed between the oval-shaped and the barrel-shaped sections. The barrel section is narrower than the rectangular section, thus forming ears on each side of the barrel section along the lower edge of the rectangular section.

An elastic member is provided which is preferably sewn lengthwise across the lower portion of the oval-shaped section. A fastener is also provided on opposite ends of the oval-shaped section for securing the bootie about the ankle of its wearer. Preferably, the fastening means has a receiving portion located near one end of the elastic member, and a fastening portion located near the opposite end of the elastic member. It is also preferable that a trim material such as bias tape be sewn around the exposed perimeter of at least the oval-shaped section, the tapered sides of the rectangular-shaped section and the lower two-thirds of the bulbous lower section.

In a process aspect, this invention relates to a method of producing a bootie out of the materials just described. The first step of the method is to cut an appropriately shaped fabric body. Preferably, an elastic member is sewn onto and across the substantially oval-shaped section of the body. Also, a fastener is attached to the oval-shaped section of the body. The bootie shape is then formed by the steps of folding the body about the corner formed by the junction of an ear and the barrel-shaped section such that the ear overlays the adjacent edge of the barrel section. Next, the bulbous section is folded about its junction with the barrel section such that the edge of the bulbous section overlays the adjacent edge of the barrel section, extending over the previously folded ear. After the appropriate folds have been made, a sewing line is drawn along the edge of the barrel section, thereby binding the ear, the barrel section and the bulbous section together near their edges. The folding and sewing steps are repeated, so that both sides are so sewn.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, wherein:

DETAILED DESCRIPTION OF THE DRAWINGS

Figure 1:
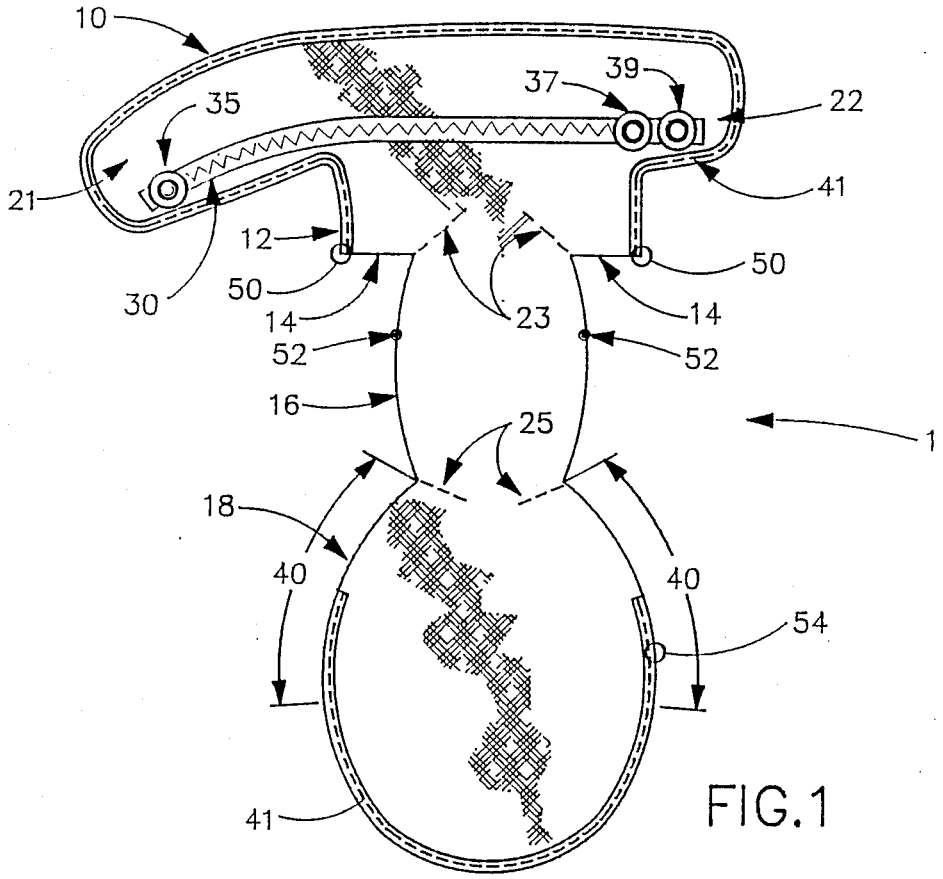
FIG. 1 is a top view of the shape of the single piece fabric body as originally cut and which can be folded, sewn and assembled into a baby bootie according to the present invention.

As shown in FIG. 1, the present invention includes a fabric body 1 fashioned from a single piece of material. The body has a substantially elongated, oval-shaped upper section 10, a substantially barrel-shaped center section 16, a substantially bulbous lower section 18, and a substantially rectangular-shaped section 12 disposed between the oval-shaped section 10 and the barrel-shaped section 16. One side of rectangular section 12 is tapered slightly so that its upper edge that attaches to oval-section 10 is slightly wider than its lower edge that attaches to barrel-shaped section 16. Additionally, the wider end of rectangular section 12 is flared to smoothly meet with oval-shaped section 10. The taper in rectangular section 12 is very slight, and it should be understood that section 12 could have parallel or even slightly inwardly tapered sides and still remain effective. The barrel-shaped section 16 is narrower than the rectangular section 12, thereby forming ears 14 along the lower edge of rectangular section 12 on each side of barrel-shaped section 16.

In the following description of a presently preferred embodiment, several references will be made to the relative dimensions of the various sections. These dimensions are to be construed as exemplary only and are in no way to be considered limiting. The dimensions described herein are appropriate for a medium sized baby bootie suitable for babies in the general range of four to eight months old.

The optimal shape for oval-shaped section 10 which is designed to wrap around the wearer's ankle is best understood by reference to FIG. 1. Oval-shaped section 10 is not centered over rectangular section 12, but rather has a relatively long, skewed end 21 and a shorter end 22. Thus, when the bootie is finally assembled, the skewed end 21 of oval-shaped section 10 wraps around the front of the wearer's ankle and is attached to the shorter end 22. The slanted nature of skewed end 21 provides a better fit about the wearer's ankle than would be provided if a more strict oval configuration is used. Oval-shaped section 10 is approximately two and one-quarters ($2\frac{1}{4}$) inches wide through its middle section and is about eleven (11) inches long. The rectangular-shaped portion 12 is approximately one and five-eights ($1\frac{5}{8}$) inches wide and is about five (5) inches long.

Barrel-shaped center section 16 is substantially narrower than rectangular section 12, thus forming a pair of ears 14 extending approximately one and one-eight ($1\frac{1}{8}$) inches along the lower end of rectangular section 12. The ears 14 become important when folding the fabric body 1 for sewing into the bootie shape as described hereinafter. Similarly, fold lines 23 emanate obliquely from the perimeter junctions of the barrel-shaped section 16 and the rectangular section 12. Barrel-shaped section 16 is approximately three and one half ($3\frac{1}{2}$) inches in length and then flares from a width of about two and three-quarters ($2\frac{3}{4}$) inches at its top to a widest dimension of approximately two and seven-eights ($2\frac{7}{8}$) inches and then contracts to a width of approximately two and one-half ($2\frac{1}{2}$) inches along its lower end which joins bulbous section 18. Fold lines 25 emanate obliquely from the perimeter junctions of barrel-shaped section 16 and bulbous section 18. Bulbous section 18 is approximately six and three-eights ($6\frac{3}{8}$) inches in height and five and one-eight ($5\frac{1}{8}$) inches in width at its widest point. Sewing edges 40 extend along both sides of bulbous section 18 a perimeter distance approximately equal to the distance along the exposed perimeter of each side of barrel-shaped section 16. Sewing edges 40 thus preferably extend along approximately 35 to 60 percent of the of bulbous section 18.

An elastic band 30 is stretched substantially the entire length across the lower side of oval-shaped section 10 and is sewn to the oval-shaped section 10 in a stretched condition. A snap fastener includes a male number member 35 and two spaced female members 37, 39 secured to the oval-shaped section 10 at opposite ends of the elastic band 30. Other suitable, releasable fastening means including VELCRO type hook and loop fasteners may also be used. Thus, the oval-shaped section may be wrapped and fastened around the wearer's ankle. With this construction, the oval-shaped section 10, may be wrapped around the wearer's ankle and snapped into place. The placement of the fastener sections at opposite ends of elastic band 30, results in the elastic completely encircling the wearer's ankle thereby insuring that the bootie will be firmly secured in place. Thus as the baby creeps, crawls, walks or kicks, the bootie will be much less likely to come off than conventional footwear.

Body 1 is preferably fashioned from any one of a number of soft and flexible fabrics. One such suitable fabric is a quilted cloth fabric. A trim material 41 such a bias tape is sewn around the perimeter of the portions of body 1 that are exposed when the bootie is in its finished form. Thus, as shown in FIG. 1, trim material 41 is placed around the exposed perimeters of oval-shaped section 10, the exposed, opposite sides of rectangular section 12, and the lower two-thirds ($\frac{2}{3}$) to three-quarters ($\frac{3}{4}$) portion of bulbous section 18.

To fabricate a bootie in accordance with the present invention, the shape of body 1 is first cut from an appropriate material, such as quilted cotton fabric. Bias tape is then sewn about the perimeter of body 1 wherever trim 41 is desired. Elastic member 30 is then sewn in a stretched condition laterally across the lower portion of oval-shaped section 10. The male member 35 and the two spaced female members 37 and 39 of a snap fastener are then punched into body 1 near the opposite ends of elastic tape 30.

Body 1 may then be sewn into a bootie shape through two short sewing lines, which will be described in reference to FIG. 1. The description that follows contemplates that the folding and sewing described will be accomplished initially with reference to one side and then repeated on the opposite side. Body 1 is first folded approximately along fold line 23 so that ear 14 lays beneath the adjacent portion of the perimeter of barrel-shaped section 16 such that point 50 of ear 14 is disposed beneath point 52 of the perimeter of barrel-shaped section 16. Thereafter, body 1 is folded along fold line 25 near the joinder of barrel-shaped section 16 and bulbous section 18 such that bulbous section 18 is generally beneath the barrel-shaped section 16 and such that point 54 is disposed beneath points 52 and 50. The perimeter of bulbous section 18 is aligned with the perimeter of barrel section 16 and ear 14. The perimeters are sewn together via a sewing line extending essentially from fold 23 to fold 25. As the sewing line approaches fold 25, it veers slightly towards the center of the fabric. This veering will help provide a rounded shape for the toe area of the bootie. When the foregoing process is carried out on both sides of body 1, an "inside/out" bootie is formed. The bootie is then turned right side out and is ready for use. The aforementioned sewing step could also be accomplished through the use of a single u-shaped sewing line. After making the described folds on each side, the bootie could be formed via a single sewing line beginning at one of the folds 23 down one edge of barrel-shaped section 16, across the bottom of section 16, in the vicinity of fold 25 and up the other edge of the barrel-shaped section 16.

Figure 2:
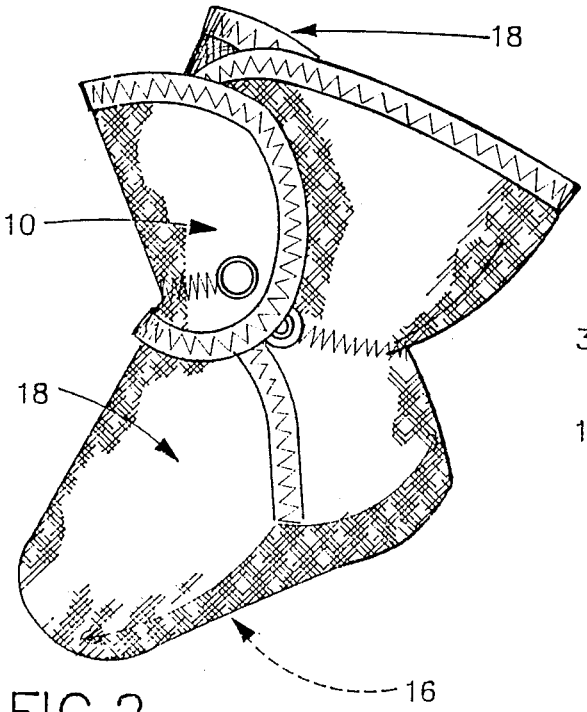
FIG. 2 is a side a view of a baby bootie fashioned from the single piece fabric body shown in FIG. 1.
Figure 3:
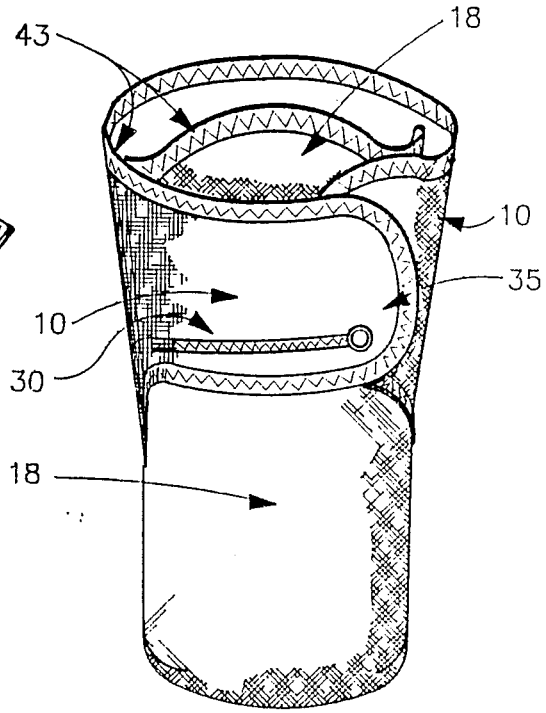
FIG. 3 is a front view of the bootie shown in FIG. 2.

It will be appreciated that bulbous section 18 essentially forms the top and tongue of the newly completed bootie. FIG. 2 depicts a side view of the completed bootie, and FIG. 3 depicts a front view of the completed bootie. A bootie constructed as described, when unsnapped, has a huge opening into which the wearer's foot is inserted. Oval-shaped section 10 is then wrapped around the back of the wearer's ankle and snapped in the front.

A bootie fashioned in the described material from a single piece of material has the additional advantage of being manufactured in a relatively consistent, uniform size and shape. When a bootie is fashioned from multiple piece of fabric, many more cutting, sewing and assembly operation are required, which not only increases the costs of manufacture, but also causes variations in the size, shape and appearance of the final product.

To enhance traction of the bootie when the baby stands and/or walks, a non-slip surface may be added to the bottom of the formed bootie. To accomplish this, an appropriate sheet of material having a non-slip surface, such as vinyl "jiffy grip" brand traction pad manufactured by Staple Sewing Aids of Garfield, N.J., is sewn to the exposed surface of barrel-shaped section 16 which forms the bottom of the completed bootie. Thus, the non-slip surface may be incorporated into the bootie construction either by sewing it to the exposed surface of section 16 prior to folding and sewing body 1 into the bootie shape or by overlaying it on the barrel-shaped section 16 and securing it to body 1 by the same sewing operation that forms the bootie shape. In this latter procedure the sew line would extend around the entire periphery of the non-slip surface. The non-slip surface may alternatively or additionally secured to the body 1 with a suitable adhesive.

Although only one embodiment of the present invention has been described herein, it should be understood that the present invention may be embodied in many other specific forms without departing from the spirit or scope of the invention. While the geometric shapes of a preferred embodiment of the bootie have been described in detail, it should be understood, that the shapes are not necessarily so limited. For example, section 12 has been described as being substantially rectangular, it could instead be substantially trapizoidal. Similarly barrel-shaped section 16 could be more rectangular. Also, the shapes of oval-shaped section 10 and bulbous section 18 may be altered without departing form the spirit scope of the present invention. Additionally, elastic band 30 has been described as extending laterally substantially all the way across oval-shaped section 10. A single elastic band or multiple elastic bands could be disposed in many positions within oval-shaped section 10 to provide the same effect. Therefore, the present example and embodiment is to be considered as illustrative and not restrictive, and the invention is not to be limited to the details given herein, but may be modified within the scope of the appended claims.

What I claim is:

1. A bootie to be worn on a foot comprising:

a body having:

a substantially oval-shaped upper section adapted to wrap about the wearer's ankle, a substantially barrel-shaped center section having at least two exposed edges and adapted to cover the sole of the foot, a substantially bulbous lower section adapted to cover the upper portion of the foot or the instep of the foot, a substantially rectangular-shaped section disposed between said barrel-shaped section and said oval-shaped section, said rectangular section having at least two exposed sides and a lower surface that joins said barrel-shaped section, and a pair of ears formed along the lower surface of said rectangular section, said ears adapted to be substantially permanently stitched to said barrel-shaped section and to said bulbous lower section to form a pocket; and thread substantially permanently stitching said ears to said barrel-shaped section and to said bulbous lower section to form a pocket; and means associated with said oval-shaped section for tightening the bootie about the wearer's ankle.

2. A bootie as described in claim 1 wherein said body is fashioned from a single piece of material.

3. A bootie as described in claim 1 wherein said tightening means includes an elastic band attached to said oval-shaped upper section while in a stretched condition.

4. A bootie as described in claim 3 wherein said fastening means further includes at least two interacting cooperating sections of a fastening device, one of said fastening device sections disposed on one end of said elastic band and the other of said fastening sections disposed on the other end of said elastic band.

5. A bootie as described in claim 1 wherein said tightening means includes at least two interacting, cooperating sections of a fastening device, one of said fastening device sections disposed on one end of said oval-shaped upper section and the other of said fastening device sections disposed on the other end of said oval-shaped upper section.

6. A bootie as described in claim 5 wherein said fastening device comprises a snap fit male section and a female section.

7. A bootie as described in claim 1 further comprising trim disposed substantially around the exposed perimeters of:

said oval-shaped upper section;

said exposed sides of said rectangular-shaped section; and the lower 50% to 75% of said bulbous lower section.

8. A bootie as described in claim 7 wherein said trim comprises bias tape, and said body section is fashioned from a quilted fabric.

9. A bootie as described in claim 1 wherein said fabric body is adapted to completely cover the wearer's foot such that no portion of the wearer's foot is exposed to the external environment.

10. A bootie as described in claim 9 wherein said fabric body is adapted to completely cover the wearer's foot and ankle such that no portion of the wear's foot and ankle is exposed to the external environment.

11. A bootie to be worn on a foot comprising:

a body of material that may be folded and sewn such that a pocket is substantially permanently formed to accept and completely cover a foot, a tongue is formed to cover the upper portion of the foot or the instep of the foot, and an ankle portion is formed to wrap about the wearer's ankle; and means for tightening the bootie about the wearer's foot consisting of means connected to said ankle portion for tightening said ankle portion around the wearer's ankle.

12. A bootie as described in claim 11 wherein said ankle tightening means includes an elastic band attached to said ankle portion while in a stretched condition and extending substantially the entire length of said ankle portion.

13. A bootie as described in claim 12 wherein said tightening means further includes at least two interacting cooperating sections of a fastening device, one of said fastening device sections disposed on one end of said elastic band and the other of said fastening sections disposed on the other end of said elastic band.

14. A bootie as described in claim 11 wherein said tightening means includes at least two interacting, cooperating sections of a fastening device, one of said fastening device sections disposed on one edge of said ankle portion and the other of said fastening device sections disposed on an opposing edge of said ankle portion.

15. A bootie as described in claim 14 wherein said fastening device comprises a snap fit male section and a female section.

16. A bootie as described in claim 11 wherein said pocket is substantially permanently formed by stitching.

17. A bootie as described in claim 11 wherein said pocket, said tongue, and said ankle portion are adapted to completely cover the wearer's foot and ankle such that no portion of the wearer's foot and ankle is exposed to the external environment.

18. A bootie as described in claim 11 wherein said body is fashioned from a single piece of material.

19. A body for fashioning into a bootie to be worn on and to completely cover a foot such that no portion of the wearer's foot is exposed to the external environment, said body comprising:

a substantially oval-shaped upper section adapted to wrap about the wearer's ankle;

a substantially barrel-shaped center section having at least two exposed edges and adapted to cover the sole of the foot;

a substantially bulbous lower section adapted to cover the upper portion of the foot or the instep of the foot;

a substantially rectangular shaped section disposed between said barrel-shaped section and said oval-shaped section, said rectangular section having at least two exposed sides and a lower surface that joins said barrel-shaped section; and a pair of ears formed along the lower surface of said rectangular section, said ears adapted to be permanently connected to said barrel-shaped section and to said bulbous lower section such that a pocket is formed to accept and completely cover the wearer's foot.

20. A body as described in claim 19 wherein said substantially oval-shaped section joins said substantially rectangular section in an off-centered manner, said substantially oval-shaped section having a relatively long end extending beyond a first side of said rectangular section and a relatively short end extending beyond a second side of said rectangular section.

21. A fabric body as described in claim 20 wherein said long end is angled or skewed relative to said short end.

22. A body as described in claim 19 further comprising an elastic band attached to said oval-shaped upper section while in a stretched condition and extending substantially the entire length of said oval-shaped upper section.

23. A body as described in claim 19 fashioned from a single piece of material.

24. A body for fashioning into a bootie to be worn on a foot, said body consisting essentially of:

a substantially oval-shaped upper section, the length of which extends substantially laterally along the width of the overall body;

a substantially barrel-shaped center section, the length of which extends substantially longitudinally along the length of the overall body;

a substantially rectangular-shaped section disposed between said barrel-shaped center section and said oval-shaped upper section;

a substantially bulbous lower section, the length of which extends substantially longitudinally along the length of the overall body; and wherein the widest width of the body at said oval-shaped upper section is wider than the widest width of the body at said barrel-shaped center section and wherein the widest width of the body at said barrel-shaped center section is narrower than the widest width of the body at said bulbous lower section.

25. A body as described in claim 15 wherein the widest width of the body at said oval-shaped upper section is wider than the widest width of the body at said bulbous lower section.

26. A body as described in claim 24 wherein said oval-shaped upper section is adapted to wrap about the wearer's ankle, wherein said barrel-shaped center section is adapted to cover the sole of the foot, and wherein said bulbous lower section is adapted to cover the upper portion of the foot or the instep of the foot.

27. A body as described in claim 24 wherein said body is fashioned from a single piece of material.

28. A bootie to be worn on a foot comprising:

a body including:

a substantially oval-shaped upper section adapted to wrap about the wearer's ankle, a substantially barrel-shaped center section adapted to cover the sole of the foot, and a substantially bulbous lower section adapted to cover the upper portion of the foot or the instep of the foot; and means for tightening the bootie about the wearer's foot consisting of means connected only to said oval-shaped upper section for tightening said oval-shaped upper section around the wearer's ankle.

29. A bootie as described in claim 28 wherein said body is fashioned from a single piece of material.

30. A bootie as described in claim 28 wherein said ankle tightening means includes an elastic band attached to said oval-shaped upper section while in a stretched condition and extending substantially the entire length of said oval-shaped upper section.

31. A bootie as described in claim 28 wherein said body is adapted to completely cover the wearer's foot such that no portion of the wearer's foot is exposed to the external environment.

32. A bootie as described in claim 31 wherein said body is adapted to completely cover the wearer's foot and ankle such that no portion of the wearer's foot and ankle is exposed to the external environment.

33. A shoe to be worn on a foot comprising:

a body of material including:

an upper section adapted to wrap about the wearer's ankle;

a center section adapted to cover the sole of the foot, and a lower section adapted to cover the upper portion of the foot or the instep of the foot, said center section being disposed intermediate to said upper section and said lower section; and means for tightening the shoe about the wearer's foot consisting of means connected only to said upper section for tightening said upper section around the wearer's ankle.

34. A shoe as described in claim 33 wherein said ankle tightening means includes an elastic band attached to said upper section while in a stretched condition and extending substantially the entire length of said upper portion.

35. A shoe as described in claim 33 wherein said body is adapted to completely cover the wearer's foot such that no portion of the wearer's foot is exposed to the external environment.

36. A bootie as described in claim 33 wherein said body is adapted to completely cover the wearer's foot and ankle such that no portion of the wearer's foot and ankle is exposed to the external environment.

37. A shoe as described in claim 33 further including thread substantially permanently stitching the edges of said center section to the edges of said lower section to form a pocket.

38. A shoe as described in claim 33 wherein said body is fashioned from a single piece of material.

39. A shoe to be worn on a foot comprising:

a body of material including:

an upper section adapted to wrap about the wearer's ankle;

a center section adapted to cover the sole of the foot; and a lower section adapted to cover the upper portion of the foot or the instep of the foot to form a tongue;

an elastic band attached to said upper section, said elastic band adapted to surround the wearer's ankle; and means for selectively adjusting the effective length of said elastic band when in a condition of surrounding the wearer's ankle.

40. A shoe as described in claim 39 wherein said elastic band is substantially permanently affixed to said upper section.

41. A shoe as described in claim 39 wherein said adjusting means includes at least one first fastening section of a pair of interacting cooperating first and second fastening sections of a fastening device and at least two second fastening sections of a pair of interacting cooperating first and second fastening sections of a fastening device, said first fastening section disposed on one end of said elastic band, and said two second fastening sections disposed in a spaced apart relation on the other end of said elastic band.

42. A shoe as described in claim 39 wherein said upper section possesses opposing ends, wherein one of said opposing upper section ends is adapted to overlap the other of said opposing upper section ends when said upper section wraps about the wearer's ankle, and wherein both of said opposing upper section ends are adapted to overlap said lower section when said upper section wraps about the wearer's ankle.

43. A shoe as described in claim 42 wherein said adjusting means is attached only to said opposing upper section ends.

44. A shoe as described in claim 43 wherein said elastic band is substantially permanently affixed to said upper section.

45. A shoe as described in claim 39 further comprising thread substantially permanently stitching the edges of said center section to the edges of said lower section to form a pocket.

46. A shoe to be worn on a foot comprising:

a body of material including:

an upper section adapted to wrap about the wearer's ankle, said upper section possessing opposing ends, wherein one end of said opposing upper section ends is adapted to overlap the other of said opposing upper section ends when said upper section wraps about the wearer's ankle;

a center section adapted to cover the sole of the foot; and a lower section adapted to cover the upper portion of the foot or the instep of the foot to form a tongue, wherein both of said opposing upper section ends are adapted to overlap said lower section when said upper section wraps about the wearer's ankle; and means connected to said opposing upper section ends for tightening said upper section around the wearer's ankle.

47. A shoe as described in claim 46 wherein said tightening means includes an elastic band substantially permanently attached to said upper section while in a stretched condition and extending substantially the entire length of said upper section.

48. A shoe as described in claim 47 wherein said tightening means further includes at least two interacting cooperating sections of a fastening device, one of said fastening device sections disposed on one end of said elastic band and the other of said fastening sections disposed on the other end of said elastic band.

49. A shoe as described in claim 46 wherein said tightening means includes at least two interacting, cooperating sections of a fastening device, one of said fastening device sections disposed on one of said opposing upper section ends and the other of said fastening device sections disposed on the other of said opposing upper section ends.

50. A shoe as described in claim 49 wherein said fastening device comprises a snap fit male section and a female section.

51. A shoe as described in claim 46 further comprising thread substantially permanently stitching the edges of said center section to the edges of said lower section to form a pocket.

52. A shoe as described in claim 46 wherein said shoe is adapted to completely cover the wearer's foot and ankle such that no portion of the wearer's foot and ankle is exposed to the external environment.

* * * * *